US010328691B2

(12) United States Patent
Keller et al.

(10) Patent No.: US 10,328,691 B2
(45) **Date of Patent: *Jun. 25, 2019**

(54) SYSTEMS AND METHODS FOR HEATING AND MEASURING TEMPERATURE OF PRINT HEAD JET STACKS

(71) Applicant: XEROX CORPORATION, Norwalk, CT (US)

(72) Inventors: Curtis Douglass Keller, West Linn, OR (US); Gautam Dhar, Tigard, OR (US); David Lylell Knierim, Wilsonville, OR (US); Chad David Freitag, Portland, OR (US); Jonathan Robert Brick, Tualatin, OR (US); Douglas Dean Darling, Portland, OR (US); Nasser Alavizadeh, Tigard, OR (US); Bradford Stewart, Vancouver, WA (US); William Bruce Weaver, Canby, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/898,129

(22) Filed: Feb. 15, 2018

(65) Prior Publication Data

US 2018/0170041 A1 Jun. 21, 2018

Related U.S. Application Data

(62) Division of application No. 13/973,794, filed on Aug. 22, 2013, now Pat. No. 9,931,840.

(51) Int. Cl.

| | |
|---|---|
| ***B41J 2/045*** | (2006.01) |
| ***B41J 2/17*** | (2006.01) |
| ***B41J 2/175*** | (2006.01) |

(52) U.S. Cl.

CPC ..... *B41J 2/04563* (2013.01); *B41J 2/04573* (2013.01); *B41J 2/04581* (2013.01); *B41J 2/1707* (2013.01); *B41J 2/17593* (2013.01)

(58) Field of Classification Search

CPC ... B41J 2/1408; B41J 2/04528; B41J 2/04563

See application file for complete search history.

(56) References Cited

U.S. PATENT DOCUMENTS

| | | | |
|---|---|---|---|
| 4,149,066 | A | 4/1979 | Niibe |
| 4,797,537 | A | 1/1989 | Berthelius et al. |

(Continued)

*Primary Examiner* — Shelby L Fidler

(74) *Attorney, Agent, or Firm* — Miller Nash Graham & Dunn LLP

(57) ABSTRACT

A print head has a jet stack, a jet stack heating and temperature measuring element thermally connected to the jet stack, the jet stack heating and temperature measuring element including: a first, etched copper layer having heat spreading characteristics and including a resistive heat source electrically connected in series to a voltage source and a switch; an electrically insulative on a back side of the first copper layer; and a second, etched copper layer on a side of the electrically insulative layer opposite the first copper layer, the second copper layer having a temperature sensing element to sense a temperature of the print head without a thermistor, the temperature sensing element connected in series with a voltage source and a transistor. A print head may use a thermistor but the heat spreading layer eliminates the need for a heat sink to attach to the print head.

18 Claims, 3 Drawing Sheets

(56) References Cited

U.S. PATENT DOCUMENTS

| | | | | |
|---|---|---|---|---|
| 5,175,565 | A | 12/1992 | Ishinaga et al. | |
| 6,033,065 | A | 3/2000 | Ikezaki | |
| 6,142,611 | A | 11/2000 | Pan | |
| 6,193,365 | B1 | 2/2001 | Ikezaki | |
| 9,320,086 | B2 | 4/2016 | Strehlow | |
| 9,931,840 | B2 * | 4/2018 | Keller | B41J 2/04563 |
| 2002/0014485 | A1 | 2/2002 | Fernando et al. | |
| 2003/0152130 | A1 | 8/2003 | Heine et al. | |
| 2005/0146584 | A1 | 7/2005 | Godil et al. | |
| 2006/0017774 | A1 * | 1/2006 | Beak | B41J 2/04563<br>347/44 |
| 2007/0062925 | A1 * | 3/2007 | Park | A61M 5/44<br>219/388 |
| 2007/0132812 | A1 * | 6/2007 | Massopust | B41J 2/0057<br>347/59 |
| 2009/0321415 | A1 | 12/2009 | Zhang et al. | |
| 2010/0079533 | A1 * | 4/2010 | Gulvin | B41J 2/04528<br>347/17 |
| 2013/0115724 | A1 | 5/2013 | Kearl et al. | |
| 2014/0361004 | A1 | 12/2014 | Jang et al. | |

* cited by examiner

SYSTEMS AND METHODS FOR HEATING AND MEASURING TEMPERATURE OF PRINT HEAD JET STACKS

CROSS REFERENCE TO RELATED APPLICATION

This application is a divisional of U.S. patent application Ser. No. 13/973,794, filed Aug. 22, 2013, which is incorporated by reference in its entirety.

TECHNICAL FIELD

This disclosure relates to print head and flexible circuits, more particularly to temperature sensing and heat in flexible circuits and print heads.

BACKGROUND

Ink in a print head of a printer is often heated and the temperature of the ink regulated. Temperatures of the ink should be within a recommended range of temperatures to ensure the highest print quality and the minimum risk of damage to the printer's components. Temperature measurement and monitoring is usually performed and incorporated into the print head itself to maintain the temperature of the print head in the recommended temperature range.

Conventional temperature measurement devices include thermistors placed at each side of the jet stack of a print head. Recent changes in high jet density print head designs have adopted flexible or "flex" circuit technology as the preferred method of including electronic components in the print heads. Further, space constraints for new print head designs provide little room for conventional thermistors.

Still further, thermistors experience frequent failure and are a major reason that print heads need maintenance or need to be replaced. Thermistors also are a separate component that needs to be attached to the print head during the manufacturing process, which presents separate failure issues. The failure rate, design and space constraints, cost, and difficult maintenance, make thermistors a poor design choice for the temperature measurement component for print head jet stacks. Embodiments of the disclosure address these and other limitations of the currently available methods and systems of temperature measurement in print head jet stacks.

SUMMARY

An embodiment is a print head including a jet stack, a jet stack heating and temperature measuring element that is thermally connected to the jet stack, the jet stack heating and temperature measuring element including: a first copper layer having heat spreading characteristics through the first layer and including a resistive heat source the restive heat source electrically connected in series to a voltage source and a switch; an electrically insulative on a back side of the first copper layer; and a second copper layer on a side of the electrically insulative layer opposite the first copper layer, the second copper layer having a temperature sensing element to sense a temperature of the print head without a thermistor, the temperature sensing element connected in series with a voltage source and a transistor.

An embodiment is a print head including a jet stack, a jet stack heating and temperature measuring element that is thermally connected to the jet stack, the jet stack heating and temperature measuring element including: a first copper layer having heat spreading characteristics through the first layer thereby avoiding the use of a heat sink, and including a resistive heat source electrically connected in series to a voltage source and a switch; an electrically insulative on a back side of the first copper layer; and a second copper layer on a side of the electrically insulative layer opposite the first copper layer, the second copper layer having a temperature sensing element to sense a temperature of the print head, the temperature sensing element connected in series with a voltage source and a transistor.

DETAILED DESCRIPTION

Throughout the disclosure, some terms are used frequently and are defined as follows. A print head is an element of a printing apparatus that applies ink to media. A jet stack is the portion of the printing apparatus that includes ejectors for dispensing ink, which may include a silicon chip and associated channels, or layers of stainless steel or polyimide with piezoelectric ceramic actuators. A flexible circuit, or flex circuit, is one or more conductive layers, typically copper, adhered to a flexible substrate such as a plastic. A heat source layer or first layer having a heat source is a layer within the disclosed flex circuits that provides heat to the jet stack. A temperature measurement layer or second layer having a temperature sensing element is a layer within the disclosed flex circuits used to sense the temperature of the jet stack. An insulative layer is a layer of the flex circuit that prevents electrical conductivity and includes any suitable insulating material(s), typically polyimide. A print head controller is any suitable printing apparatus component that can control operations of the print head, such as an electronic circuit that includes a processor.

A single flex circuit includes a heat source, heat spreading, and thermal feedback, as described in this disclosure. The single flexible circuit component can be included in a print head of the printing apparatus in any suitable manner, serving as both a jet stack heating and temperature measuring element. The jet stack heating and temperature measuring element is thermally connected to the print head's jet stack.

Figure 1:
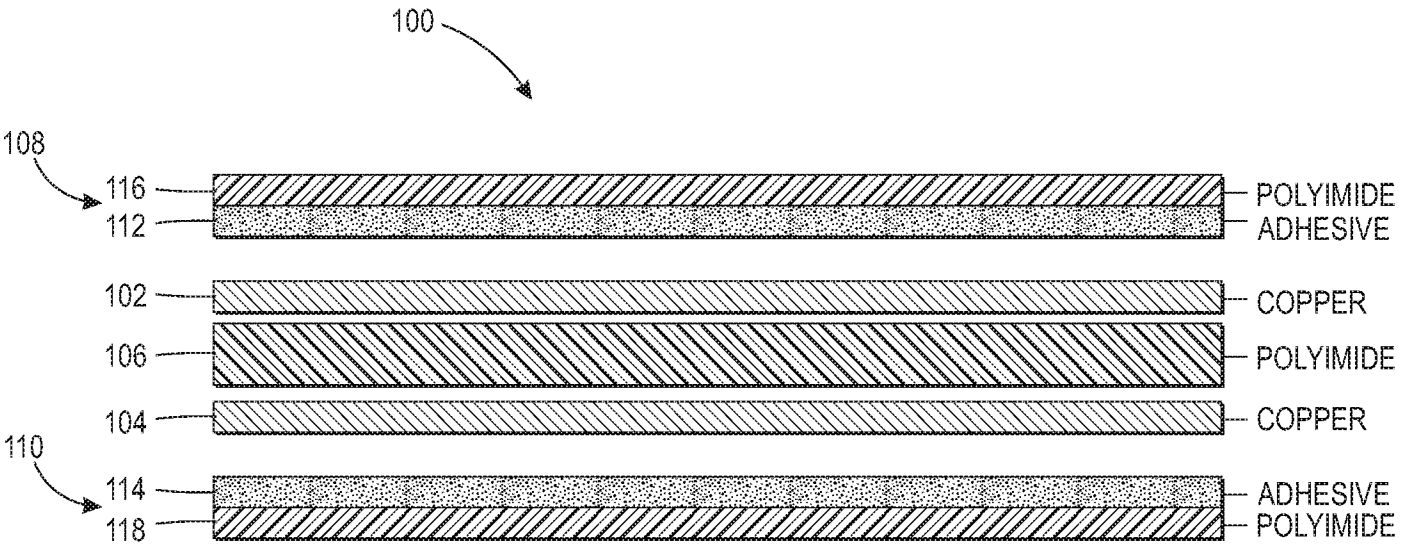
FIG. 1 is a cross-sectional view of a portion of an example flex circuit that heats a print head jet stack and determines the temperature of print head jet stack.

FIG. 1 shows a cross-section of a portion of an example flex circuit 100. The example flex circuit 100 shown in FIG. 1 is a multi-layer etched copper flex circuit that provides heat and thermal feedback. A first layer 102 of the disclosed flex circuit 100 includes a resistive heater and is designed to heat the print head jet stack. The first layer 102 can include an etched copper circuit design in which copper traces form the resistive heat source. The resistive heat source of the first layer 102 can also include gold used in combination with or instead of the copper traces. Other suitable conductive materials can also be used.

The flex circuit 100 also includes a second, backside etched copper layer 104 formed by copper trace circuit components. The second, backside copper traces include a temperature sensing element that measures the temperature of the print head jet stack. Other suitable materials may be used in combination with or instead of copper, as discussed above regarding the first layer 102

An insulative third layer 106 is positioned between the first layer 102 and the second layer 104 of the example flex circuit 100 shown in FIG. 1. The third, insulative layer 106 can be any suitable material with insulating properties. The third layer 106 in the example flex circuit 100 shown in FIG. 1 includes polyimide. The third layer 106 prevents electrical conductivity between the first layer 102 and the second layer 104. The flex circuit 100 may have no conductive connection extending between the first layer 102 and the second layer 104.

The flex circuit 100 can also include a top cover film 108 and a bottom cover film 110. Both of the top cover film 108 and the bottom cover film 110 have respective adhesive layers 112, 114 and insulative layers 116, 118. The adhesive layers 112, 114 of the top cover film 108 and the bottom cover film 110 can include an acrylic or modified acrylic adhesive, such as adhesives with an A381 designation. Any other suitable single- or double-sided adhesive can also be used. The insulative layers 116, 118 of the top cover film 108 and the bottom cover film 110 can include polyimide or any other suitable material having insulating properties.

Figure 2:
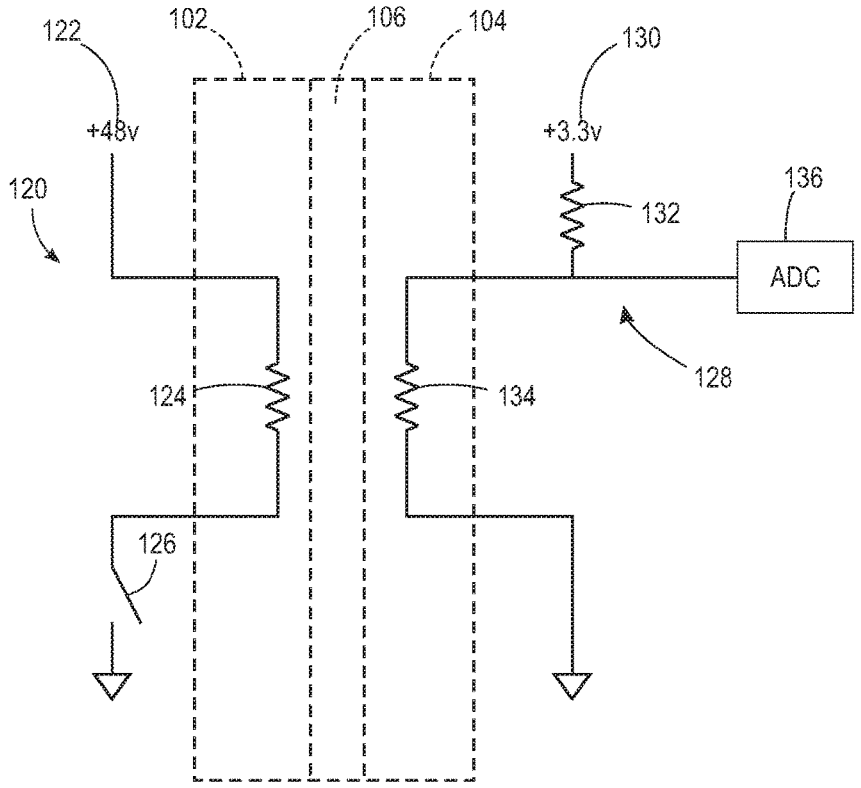
FIG. 2 is an example schematic of two flex circuit traces and that exist in two layers of the flexible circuit shown in FIG. 1, along with associated circuitry.

FIG. 2 shows a circuit schematic including the first layer 102, the second layer 104, and the insulative, third layer 106 of the flex circuit 100 shown in FIG. 1. The first layer 102 includes a resistive heat source 124 typically connected to a voltage source 122 and a switch 126, that are all electrically connected in series.

The second layer 104 includes a temperature sensing element 134 typically connected to a voltage source 130 and a resistor 132 that are electrically connected in series, as shown in FIG. 2. The temperature sensing element 134 is also typically connects to an analog-to-digital converter (ADC) 136. The second layer 104 provides heat spreading capabilities as well as thermal feedback regarding the temperature of the jet stack. The first layer 102 and the second layer 104 together provide heat spreading capabilities to evenly spread heat along the length and width of the flexible circuit 100.

FIG. 2 shows dashed boxes that represent the flex circuit. Circuit elements 122, 126, 130, 132, and 136 can be mounted either on the flexible circuit itself or on a separate rigid circuit board or another flexible circuit, as shown in FIG. 2.

In the above described examples of the disclosed flex circuits, copper is used exclusively or in combination with gold or another material to form the traces for the circuit elements. Copper traces have known electrical properties in which the resistance of the copper (R) changes approximately 0.4% for every degree Celsius (° C.). Therefore, the resistance of the copper (R) at a particular temperature $(T)=R_{ref}[1+\alpha(T-T_{ref})]$. The reference resistance ($R_{ref}$) is a reference resistance of the copper at a reference temperature ($T_{ref}$). Frequently, $T_{ref}$ is 20° C., but can alternatively be 0° C. A temperature coefficient ($\alpha$) of R, the resistance of the copper, is a measurement of the change in physical property, in this case the R of the copper, as the temperature increases by a set amount, usually 1 Kelvin (K). The equation described here is not unique to copper and can be calculated for any conductive material used in the flex circuit, including gold, a gold and copper combination, or the like.

Figure 3:
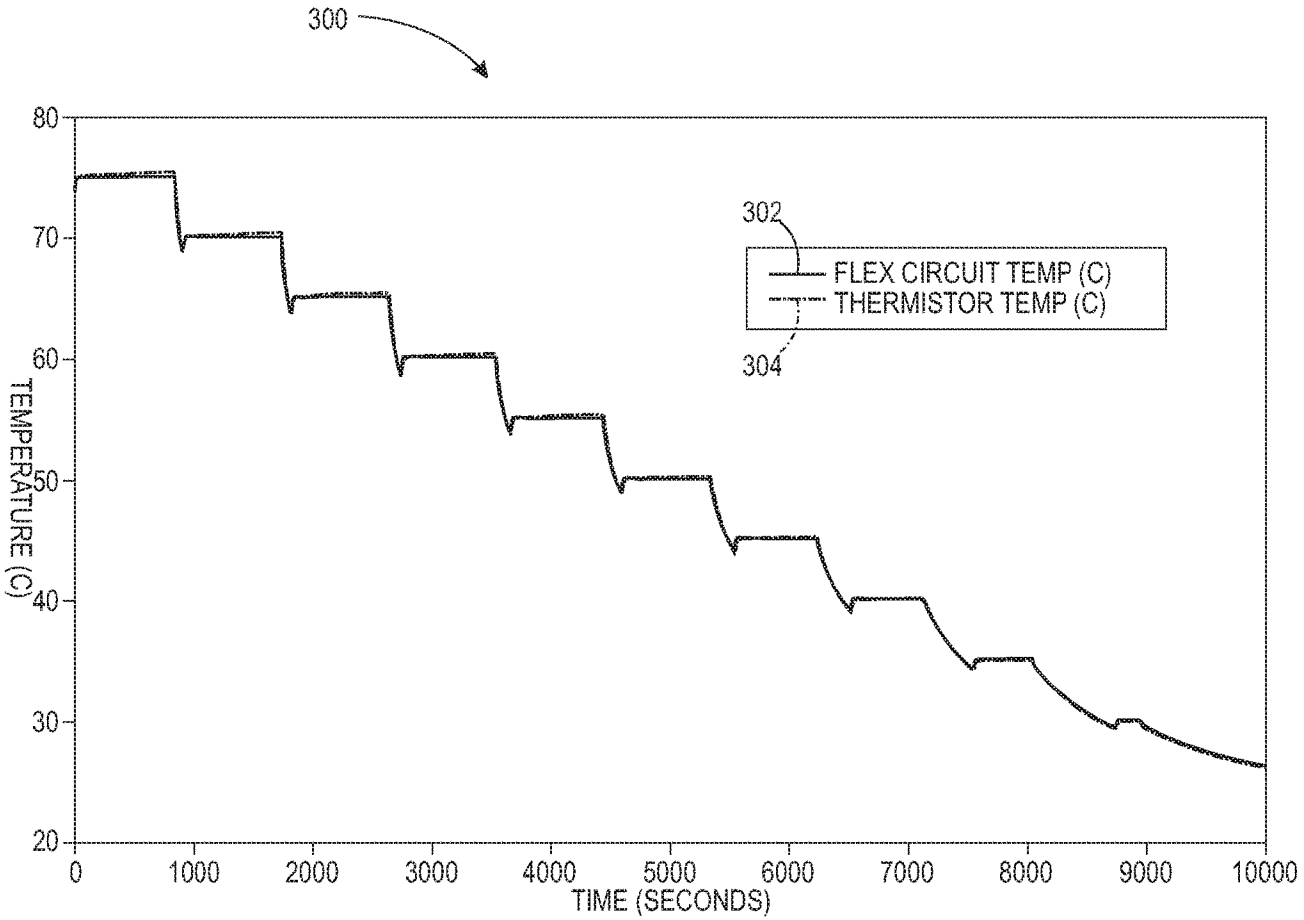
FIG. 3 is a chart showing a temperature feedback comparison between conventional thermistors' measurement of the temperature of print head jet stacks and the disclosed systems and methods for measuring temperature of print head jet stacks.

FIG. 3 is a graph 300 showing a comparison of the measured temperatures using the disclosed flex circuit 302 and the measured temperatures using a conventional thermistor 304. The jet stack temperatures measured by the disclosed flex circuit 203 closely track the temperatures measured by conventional thermistors within an acceptable tolerance.

The above disclosed flex circuits can be used to measure the temperature of a print head jet stack. The temperature measurements can be sent to a print head controller that can adjust the temperature of the jet stack based on the received measurements. Oftentimes, the desired operation of the print head requires the jet stack to maintain a temperature within a defined range of temperatures.

The print head jet stack can be heated by the heat source of the first layer of the flex circuit examples discussed above. A value of the resistance of the second layer of the flex circuits described above is measured. The temperature sensing element of the second layer of the above described flex circuits define a resistance that changes in accordance with the temperature of the second layer, based on the properties of the material used in the second layer. The above examples include copper and/or gold in the second layer. The second layer serves as a temperature measurement layer of the flex circuit. As discussed above, the second layer is separated from the heat source or first layer by an insulative layer that prevents electrical conductivity between the first, heat source layer and the second, temperature measurement layer.

A predetermined temperature scale is created or is already known based on the properties of the materials used in the second layer to form the circuit elements of the temperature sensing elements. The measured resistance values of the second, temperature measurement layer are compared to the predetermined temperature scale. From the compared resistance values, a corresponding temperature of the second, temperature measurement layer is determined. In the example flex circuit in which the second layer includes copper traces, the resistance of the copper is measured and compared to a known temperature scale for copper to determine the associated temperature of the second layer at any given time.

The above described systems and methods may require a print head calibration step that includes measuring both the temperature of the jet stack and the resistance value of the second layer of the flex circuit to determine if any offset or gain is required. If the calibration measurements differ from the known temperature measurement scale, an offset or gain can be calculated and then applied to the resulting measured resistance when the temperature measurement system is operating.

The disclosed flex circuits reduce the number of materials required for manufacturing a print head because the flex circuits rely on an existing layer of copper (or other conductive material) on which the traces are formed. The copper traces in the second layer on the backside of the heater provide heat spreading capabilities and thus no conventional thermistor is required. Because of the simplified manufacturing and reduction in parts, both the reliability of the print heads and the cost of manufacturing the print heads improve.

It will be appreciated that variations of the above-disclosed systems and methods for measuring the temperature of print head jet stacks and other features and functions, or alternatives thereof, may be desirably combined into many other different systems, methods, or applications. Also various presently unforeseen or unanticipated alternatives, modifications, variations, or improvements therein may be subsequently made by those skilled in the art.

The invention claimed is:

1. A print head, comprising:

a jet stack;

a jet stack heating and temperature measuring element that is thermally connected to the jet stack, the jet stack heating and temperature measuring element including:

a first, etched copper layer having heat spreading characteristics through the first layer and including a resistive heat source having etched copper traces formed by etching the copper of the first layer, the restive heat source electrically connected in series to a voltage source and a switch;

an electrically insulative layer on a back side of the first copper layer; and a second, etched copper layer on a side of the electrically insulative layer opposite the first copper layer, the second copper layer having a temperature sensing element formed of etched traces formed by etching the copper of the second layer, the temperature sensing element to sense a temperature of the print head based upon a change in resistance of the temperature sensing element without a thermistor, the temperature sensing element connected in series with a voltage source and a transistor.

2. The print head of claim 1, further comprising a first adhesive layer on a front side of the first copper layer opposite the back side of the first copper layer.

3. The print head of claim 2, further comprising a top cover film on the adhesive layer, the jet stack attached to the top cover film.

4. The print head of claim 1, wherein the first, etched copper layer further includes gold traces.

5. The flexible circuit of claim 3, wherein the top cover film comprises polyimide.

6. The print head of claim 1, wherein the insulative layer prevents electrical conductivity between the first layer and the second layer.

7. The print head of claim 1, further comprising a second adhesive layer on the second, etched copper layer.

8. The print head of claim 7, further comprising a bottom cover film on the second adhesive layer.

9. The print head of claim 1, wherein the first, etched copper layer having heat spreading characteristics avoids the use of a heat sink attached to the jet stack.

10. A print head, comprising:

a jet stack;

a jet stack heating and temperature measuring element that is thermally connected to the jet stack, the jet stack heating and temperature measuring element including:

a first, etched copper layer having heat spreading characteristics through the first layer thereby avoiding the use of a heat sink, and including a resistive heat source having etched copper traces formed by etching the copper of the first layer, the restive heat source electrically connected in series to a voltage source and a switch;

an electrically insulative layer on a back side of the first copper layer; and a second, etched copper layer on a side of the electrically insulative layer opposite the first copper layer, the second copper layer having a temperature sensing element formed of etched traces formed by etching the copper of the second layer, the temperature sensing element to sense a temperature of the print head based upon a change in resistance of the temperature sensing element, the temperature sensing element connected in series with a voltage source and a transistor.

11. The print head of claim 10, further comprising a first adhesive layer on a front side of the first copper layer opposite the back side of the first copper layer.

12. The print head of claim 11, further comprising a top cover film on the adhesive layer, the jet stack attached to the top cover film.

13. The print head of claim 10, wherein the first, etched copper layer further includes gold traces.

14. The flexible circuit of claim 12, wherein the top cover film comprises polyimide.

15. The print head of claim 10, wherein the insulative layer prevents electrical conductivity between the first layer and the second layer.

16. The print head of claim 10, further comprising a second adhesive layer on the second, etched copper layer.

17. The print head of claim 16, further comprising a bottom cover film on the second adhesive layer.

18. The print head of claim 10, wherein the temperature sensing element eliminates a need for thermistors.

* * * * *